United States Patent [19]

Barcus

[11] Patent Number: 4,837,836

[45] Date of Patent: Jun. 6, 1989

[54] MICROPHONE PICKUP SYSTEM

[76] Inventor: Lester M. Barcus, 16226 Wayfarer La., Huntington Beach, Calif. 92649

[21] Appl. No.: 430,749

[22] Filed: Sep. 30, 1982

[51] Int. Cl.[4] ..... G10D 5/00

[52] U.S. Cl. ..... 381/118; 381/169; 381/92; 84/1.14

[58] Field of Search ..... 84/1.14, 1.15; 179/1 C, 179/121 C; 381/118, 169, 181, 1.25

[56] References Cited

U.S. PATENT DOCUMENTS

| | | | |
|---|---|---|---|
| 2,439,551 | 4/1948 | Telkowski | 84/DIG. 15 |
| 2,529,467 | 11/1950 | Wiggins | 179/121 D |
| 2,664,775 | 1/1954 | Zielinski | 84/DIG. 14 |
| 2,856,805 | 10/1958 | Babicky | 84/1.04 |
| 2,945,408 | 7/1960 | Terlinde | 84/DIG. 14 |
| 3,553,339 | 1/1971 | Dominguez | 84/1.15 |
| 3,725,561 | 4/1973 | Paul | 84/1.15 |
| 4,091,704 | 5/1978 | Moe | 84/1.04 X |

*Primary Examiner*—Forester W. Isen

*Attorney, Agent, or Firm*—Albert L. Gabriel

[57] ABSTRACT

A system for establishing a generally elongated and preferably also generally flat pattern of response for a microphone. A microphone pickup module according to the invention has a body with an elongated, preferably also generally flat, channel extending therethrough between generally oppositely facing open ends. A miniature pressure type microphone is mounted in the body with its sound-sensitive surface in communication with the channel intermediate the ends of the channel. The system provides improved response characteristics for the harmonica, accordion and drum.

7 Claims, 2 Drawing Sheets

FIG. 1
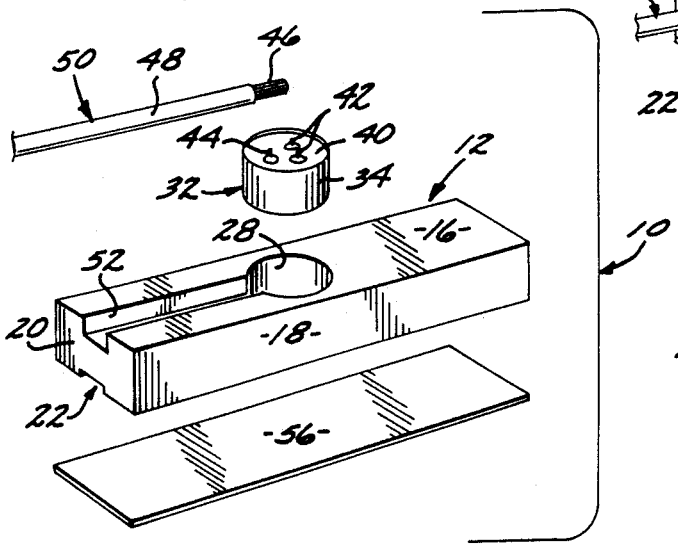
FIG. 2
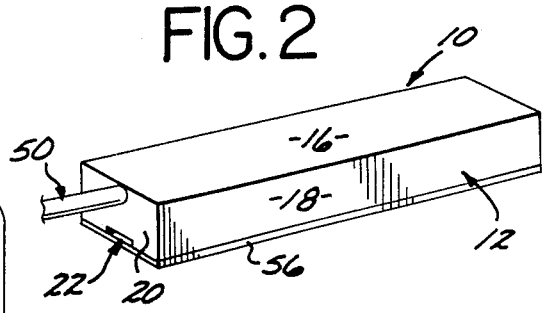
FIG. 3
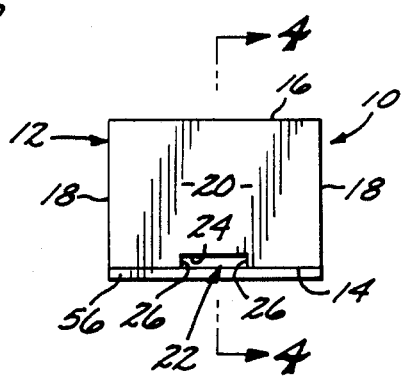
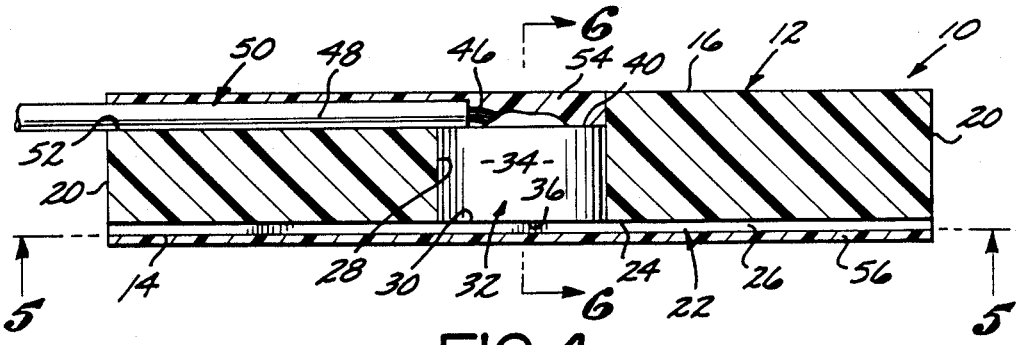
FIG. 4
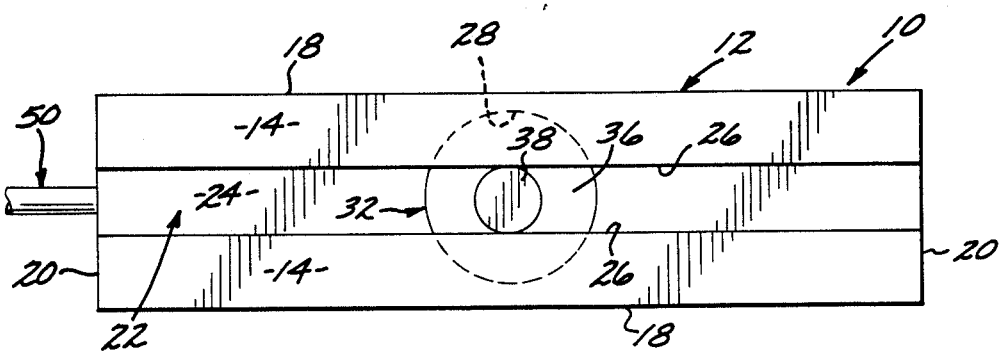
FIG. 5

MICROPHONE PICKUP SYSTEM

BACKGROUND OF THE INVENTION

1. Field of the Invention

The present invention is in the field of microphones, and the invention relates more particularly to microphones that are suitable for use in picking up sounds emitted from musical instruments.

2. Description of the Prior Art

Conventional microphones, even of the highest quality, have a number of problems in general, and particularly when employed to pick up the sounds from some types of musical instruments. One problem frequently encountered with microphones, both in the miking of musical instruments and in other uses, is a vulnerability of conventional microphones to feedback from nearby speakers. Another general problem with conventional microphones is a cavity effect which results from a conventional practice of embodying a miniature pressure type condenser microphone in a larger generally hollow microphone body. There have been a variety of attempts to overcome this problem, including pouring foam material into the cavity. However, such attempts to cure the problem generally result in diminished microphone response characteristics.

A problem that frequently arises when a conventional microphone is employed to pick up the sounds of a particular musical instrument that is being played in a group with other instruments is that it is difficult and many times impossible to selectively pick up only the sounds of the one instrument without also picking up sounds from one or more of the other instruments. This problem is greatest where the output of the particular instrument that is being selectively miked is relatively low and other nearby instruments have a relatively high output level.

Special difficulties arise in attempts to use conventional microphones in connection with the harmonica and the accordion. The harmonica has a relatively low sound output level so that it is the normal practice for the player to hold a conventional microphone inside of his cupped hands. This makes it hard to play the harmonica, it produces an undesirable hand-shrouding or barrel effect involving loud volume increases, and the microphone will sometimes hit the harmonica and cause clinking noises. Also, with a conventional microphone thus held in the cupped hands of the player, the microphone will be closer to one part of the elongated harmonica reed bank than to others, thus undesirably emphasizing a limited range of notes. Attempts to mike a harmonica by attaching a conventional miniature microphone directly to the harmonica also result in undesirable emphasis of the sounds coming from a localized portion of the elongated reed bank. The hand-held conventional microphone is also undesirably sensitive to wind noise generated when the harmonica is being played.

The accordion is normally played in front of a stationary microphone, and the locations on the accordion from which the sounds emanate, as well as the movements that are required to play the accordion, result in generally poor microphone response. Thus, the sound comes primarily out of the ends of the accordion case, and these face away from the microphone when the player is facing the microphone in the usual way. Additionally, in actuating the bellows the player is repeatedly pulling the bass section of the accordion away from the microphone. Attempts to mike an accordion by attaching miniature pressure-type microphone capsules directly to the outside or inside of the accordion generally result in a very uneven response over the frequency range of the accordion, even with the use of an undesirably large number of such microphones distributed about the accordion.

The use of a conventional microphone to pick up the sounds of drums, and particularly snare or bass drums, also involves problems, including feedback problems, pickup of an undesirable amount of room ambience, and lack of presence.

SUMMARY OF THE INVENTION

In view of these and other problems in the art, it is a general object of the present invention to provide a pickup module embodying a conventional miniature pressure-type microphone capsule but which has greatly improved response characteristics over those of a conventional microphone.

Another object of the invention is to provide a microphone pickup module which has a generally elongated region or pattern of sensitivity, whereby the pickup has special utility in connection with musical instruments having elongated sound outputs or sound generating structures, such as the elongated reed banks of the harmonica and the accordion.

Another object of the invention is to provide a microphone pickup module which has a generally flat region or pattern of sensitivity, whereby the pickup has special utility in connection with musical instruments having generally flat sound generating regions or structures, such as drums. A further object of the invention is to provide a microphone pickup module which has a discrete region or pattern of sensitivity such that the module may be conveniently associated with a particular musical instrument such as a harmonica, an accordion or a drum, so as to have good response characteristics to the sound spectrum emanating from such instrument, while at the same time being substantially insensitive to sounds emanating from other nearby instruments and room ambience sounds.

A still further object of the invention is to provide a microphone pickup module that avoids the introduction of unnatural emphases in its responses, as for example such emphases as the hand-shrouding or barrel effect produced by a conventional microphone being held in the hands of a harmonica player, or the varying response amplitude associated with the receding and advancing bass section of an accordion as the player pumps the bellows.

Yet a further object of the invention is to provide a microphone pickup module which is simple and convenient both to install and to use, and which is never in the way during operation of an instrument.

According to the invention a miniature pressure-type microphone capsule is embedded within a pickup module that has a very small, narrow sound guide slot or channel extending therethrough and opening at opposite ends of the module. The microphone capsule has an area of sound sensitivity that is exposed to the sound guide slot or channel proximate its longitudinal center, and this microphone area of sensitivity is preferably in a flat surface of the microphone that registers with and forms a continuation of one of the surfaces of the sound guide slot or channel. The small sound guide slot cooperates with the miniature pressure-type microphone to provide an elongated and generally flat pickup pattern that provides generally uniform response characteristics over the entire sound frequency range when the microphone pickup module is operatively associated with elongated sound-emitting structures such as a reed bank of a harmonica or accordion, or generally flat sound-emitting structures such as the head of a drum.

BRIEF DESCRIPTION OF THE DRAWINGS

These and other objects of the invention will become more apparent in reference to the following description and the accompanying drawings, wherein:

FIG. 1 is an enlarged, exploded perspective view of a pickup module according to the invention showing the parts thereof;

FIG. 2 is a perspective view similar to FIG. 1, but with the parts of the invention assembled;

FIG. 3 is a further enlarged end elevational view of the pickup module;

FIG. 4 is an axial section taken on the line 4—4 in FIG. 3, with portions shown in elevation;

FIG. 5 is a sectional view taken on the line 5—5 in FIG. 4;

DETAILED DESCRIPTION

Figure 6:
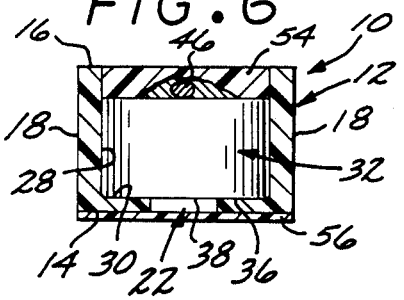
FIG. 6 is a cross-sectional view taken on the line 6—6 in FIG. 4, with a portion shown in elevation.

Referring to the drawings, the pickup of the present invention is generally designated 10, and it has a principal structural member in the form of a unitary, elongated, rigid body 12 that is preferably made of an insulation material such as a molded plastic, hard rubber, or the like. The elongated body 12 preferably has a generally rectangular cross section defined between generally flat, parallel front and back surfaces 14 and 16, respectively, side surfaces 18, and end surfaces 20.

The front surface 14 of body 12 has a longitudinally extending sound guide slot generally designated 22 therein. The slot 22 extends along the entire length of the elongated body 12, opening out at both of the ends 20 of body 12. The sound guide slot 22 is preferably transversely centered in the front surface 14, and is preferably of uniform, rectangular cross section along its entire length. The sound guide slot 22 is quite shallow relative to its width, experimental pickups according to the invention providing excellent results with slots 22 having a depth that is only about one-fifth of the width. Thus, the sound guide slot 22 has a wide, flat bottom surface 24, and narrow side edges 26.

An annular recess or bore 28 opens at back surface 16 and extends forwardly in body 12 to a flat end surface 30 that registers in the front-rear direction with the bottom surface 24 of sound guide slot 22. The annular recess or bore 28 has its axis oriented at right angles to the front and back surfaces 14 and 16, respectively, of the pickup body 12, and the recess or bore 28 is both longitudinally centered between the ends 20 of body 12 and transversely centered between the sides 18 of body 12. Thus, as seen in FIGS. 4, 5 and 6, the flat end surface 30 of recess or bore 28 is parallel to the flat front surface 14 of body 12 and is rearwardly displaced from front surface 14 the same amount as the depth of the sound guide slot 22. The bore 28 is accordingly exposed to the sound guide slot 22 along a diametrical strip as best seen in FIG. 5, but is also shown in FIGS. 4 and 6.

The annular recess or bore 28 is sized to receive therein a tiny cylindrical microphone capsule designated 32 This microphone capsule 32 is a conventional miniature pressure type condenser microphone of the "electret" type which has one sensitive flat face. The microphone capsule 32 has an annular case 34, a flat front face 36 with a round central area 38 of sensitivity, and a generally flat rear surface 40 that is parallel to the front face 36. The microphone capsule 32 fits within bore 28, with the front face 36 seated against the flat end surface 30 of bore 28, and the central area 38 of sensitivity exposed to the sound guide slot 22 as best seen in FIG. 5. The front face 36 of microphone capsule 32 registers with the flat bottom surface 24 of sound guide slot 22 in the front-rear direction of body 12, so that the front face 36 of microphone capsule 32, including the area 38 of sensitivity, actually forms a central continuation of the bottom surface 24 of slot 22. Preferably, the central area 38 of sensitivity of microphone capsule face 36 has approximately the same diameter as the width of sound guide slot 22, as shown in FIG. 5.

One or more hot terminals 42 and a ground terminal 44 project from the rear surface 40 of microphone capsule 32. The hot lead 46 and shield 48 of a coaxial cable 50 are soldered to the hot terminal 42 and ground terminal 44, respectively, to provide conventional electrical connection to amplification and/or recording equipment. An elongated cable slot 52 is provided in the back surface 16 of body 12, the cable slot 52 extending from bore 28 longitudinally to open at one of the end surfaces 20 of body 12. As best seen in FIG. 4, with the cable electrically connected to the microphone capsule 32 and capsule 32 operatively positioned within the annular recess or bore 28, the cable 50 extends from the capsule 32 longitudinally through the cable slot 52 and out of the pickup 10 from the respective end 20 thereof. The bore 28 and cable slot 52 are sufficiently deep below the back surface 16 of body 12 that the cable 50 and solder connections to microphone capsule terminals 42 and 44 are completely recessed forward of the back surface 16. The remaining space within bore 28 and cable slot 52 is filled with insulation material 54, which is preferably rigid, to flush with the back surface 16 so that the surface of insulation material 54 becomes a part of the back surface 16 of the completed pickup module 10.

A rigid front cover plate 56 is bonded flush to the front surface 14 of pickup body 12, the cover plate 56 being coextensive with the front surface 14 both longitudinally and transversely. The pickup module 10 is adapted to be mounted with its front face flush against a generally flat member of a musical instrument, such as along the generally flat rear edge of a harmonica or accordion reed bank or on a drumhead. The purpose of the rigid front cover plate 56 is to allow the use of a pliable or soft or irregular attaching means for connecting the front face of the pickup 10 to the musical instrument surface without disturbing the regularity or continuity of the sound guide slot 22. Thus, the presence of the rigid front cover plate 56 allows such attaching means as two-sided foam adhesive tape or "Velcro" to be used. However, it is to be understood that if a relatively thin and regular type of attaching means were to be employed, such as a layer of glue or cement, then the rigid cover plate 56 would not be necessary because the generally flat musical instrument surface to which the pickup 10 is attached would complete the sound guide channel of the slot 22 without disturbing the regularity or continuity thereof. Thus, either with or without the front cover plate 56, in operation the sound guide slot 22 will be covered closed at the front surface 14 of body 12 to provide a tubular sound guide leading from both ends 20 of the body 12 to the microphone sensing surface 38.

The rigid front cover plate 56 is preferably made of a plastic material that is compatible with the plastic of which the elongated body 12 is made for solvent bonding of the cover plate 56 to front surface 14 of body 12, to make the cover plate 56 and body 12 into an integral unit. If desired, the rigid cover plate 56 may be made of some other suitable rigid material, such as "fish paper" or metal.

It is to be understood that the present invention is not limited to any particular dimensions. However, to illustrate how miniature the pickup module 10 of the invention may be, and given by way of example only and not of limitation, prototypes of the present invention having approximately the following dimensions have provided excellent pickup response characteristics: the elongated body 12 had a thickness between front and back surfaces 14 and 16, respectively, of approximately ¼ inch, a width between side surfaces 18 of approximately ¼ inch, and a length between end surfaces 20 of approximately 1¼ inch. The sound guide slot 22 was approximately ⅛ inch wide by approximately 0.025 inch deep. The annular recess or bore 28 had a diameter of approximately ¼ inch, while the microphone capsule 32 had a diameter of approximately ¼ inch and an axial depth of approximately 3/16 inch deep. The central area of sensitivity 38 of microphone front face 36 had a diameter of approximately ⅛ inch. The rigid front cover plate 56 had a thickness of approximately 0.025 inch. AKG miniature pressure type microphone capsules were satisfactorily used in such prototypes.

The elongated sound guide slot 22 employed in the pickup 10 of the invention provides a generally elongated, flat directionality of sound reception in the invention which makes the invention particularly useful in connection with musical instruments that have either a generally elongated or a generally flat sound output zone. Thus, the invention has particular utility in connection with the harmonica which has an elongated reed block or bank, the accordion which has a plurality of elongated treble reed banks and a plurality of elongated bass reed banks, and the drum which has a generally flat drumhead surface from which the sound is emitted.

Figure 8:
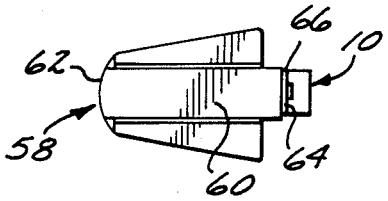
FIG. 8 is an end elevational view of the harmonica and pickup module of FIG. 7.
Figure 7:
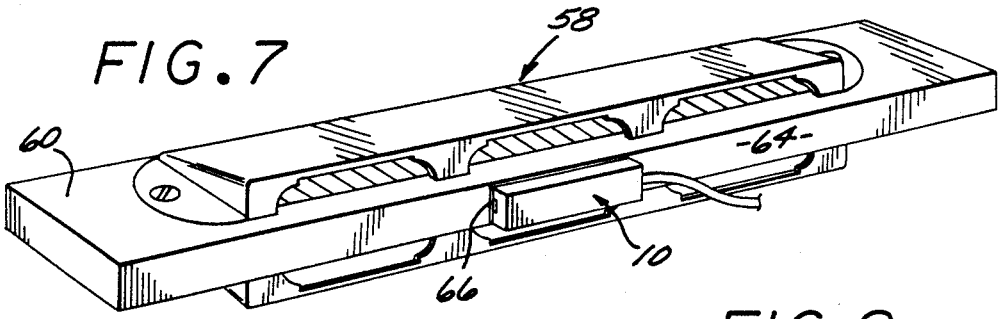
FIG. 7 is a perspective view of a harmonica having the pickup module of the invention attached thereto.
Figure 9:
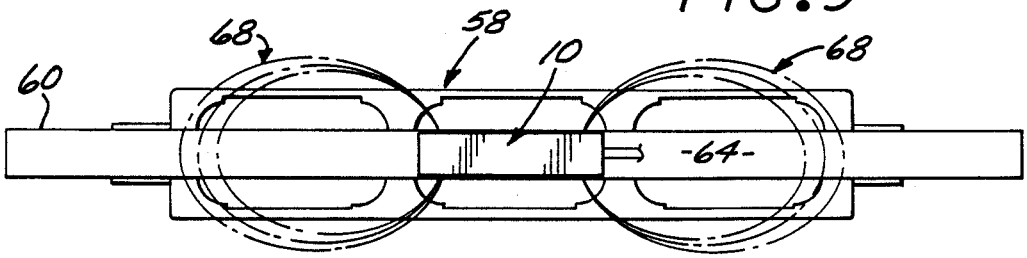
FIG. 9 is a rear elevational view of the harmonica and pickup module shown in FIGS. 7 and 8, with the pickup pattern provided by the sound guide slot or channel of the pickup module shown in phantom.

FIGS. 7, 8 and 9 illustrate the pickup module 10 of the invention operatively mounted on a harmonica generally designated 58. The harmonica 58 includes elongated reed bank 60 that has a front playing edge 62 and a straight, flat rear edge surface 64 to which the front face of the pickup cover plate 56 is connected by attaching means 66 such as two-sided foam adhesive tape, "Velcro", or other conventional attaching means. "Velcro" is particularly useful for the harmonica, in that it allows a single pickup module 10 to be employed on a plurality of different harmonicas which some performers will regularly use.

As seen in FIGS. 7 and 9, the pickup module 10 is attached at the longitudinal center of the rear edge 64 of reed bank 60. The longitudinal directionality of pickup 10 gives it a pickup response pattern from sound that is received through the ends of sound guide slot 22 somewhat resembling a butterfly, encompassing two generally oval lobes 68 shown in phantom lines in FIG. 9 which extend longitudinally from proximate the respective ends of the pickup 10. This pickup response pattern indicated by the lobes 68 provides a generally uniform sensitivity of the pickup module 10 to both the bass and the treble portions of the reed bank 60; while the more proximate and hence stronger center midrange sound will more directly penetrate through the cover plate 56. The result is an equalizing effect producing a generally uniform response of the pickup module 10 along the entire length of the harmonica reed bank 60.

Figure 10:
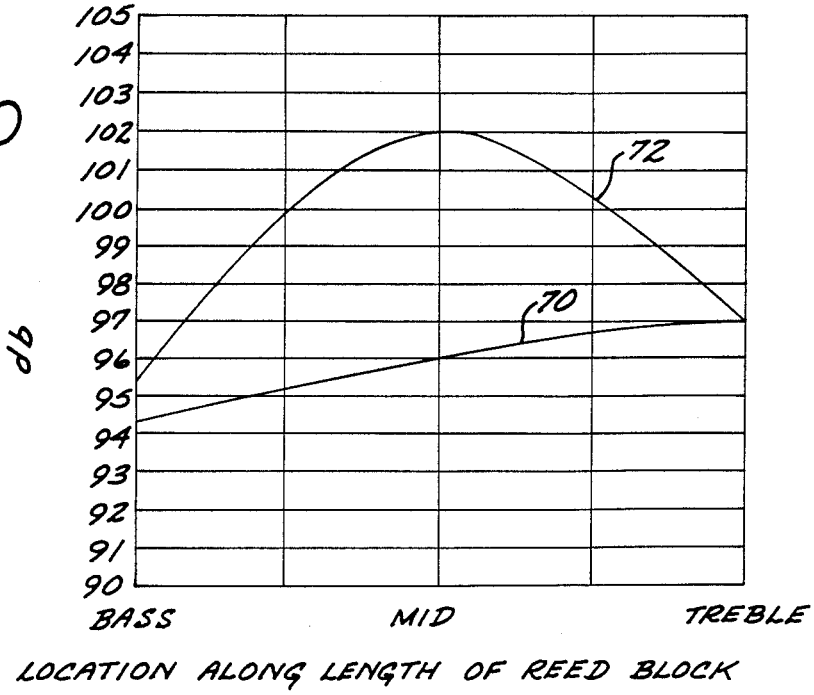
FIG. 10 is a graph comparing the response curve of the pickup module on the harmonica of FIGS. 7–9 with the response curve for a conventional exposed microphone held close to the center of the rear edge of the reed block of the harmonica of FIGS. 7–9.

In the graph of FIG. 10 the abscissas indicate locations along the rear edge 64 of the harmonica reed bank 60 from bass end to treble end; while the ordinants indicate amplified output of the pickup 10 in decibels. Curve 70 is the response curve of a pickup module 10 of the invention which was attached to the center of the rear edge 64 of reed bank 60 by two-sided foam tape. It is to be noted that the response curve 70 of the invention is fairly close to a straight line curve, ranging from 94.3 db at the bass end of the reed bank to 97.0 db at the treble end of the reed bank, with a 96.0 response at the center of the reed bank. In contrast to the response curve 70 of the invention, the response curve 72 of FIG. 10 is the response curve for a conventional exposed microphone held close to the center of the rear edge 64 of the reed bank 60. This conventional microphone response curve 72 was produced by a very high quality B&K Laboratory microphone having a very good hemispherical response. It is to be noted that the response curve 72 ranges from 95.4 db at the bass end of the reed bank all of the way up to 102.0 db at the center of the reed bank, and then back down to 97.0 db at the treble end of the reed bank. The response curves 70 and 72 were produced with an IVIE IE-30A audio analyzer.

Pickup modules 10 of the invention are applied to an accordion in much the same manner as to a harmonica. Thus, a module 10 may be attached along the rear edge of one of the three treble reed banks of the accordion, proximate the longitudinal center thereof, to pick up the sounds from the entire treble side of the accordion; while one of the pickup modules 10 may be longitudinally centered along the rear edge of one of the bass reed banks of the accordion to pick up the sounds from the bass side. Because of the extended lengths of the treble reed banks, the treble response can be optimized by employing two of the pickup modules 10 located at approximately the one-third and two-thirds points along the length of one of the treble reed banks. Because of the shorter lengths of the bass reed banks, a single one of the pickup modules 10 longitudinally centered on one of the bass reed banks will provide a substantially optimum response.

A single pickup module 10 attached to a drumhead provides excellent response characteristics. The module 10 is attached to the drumhead with the front cover plate 56 facing the drumhead and preferably attached by two-sided foam adhesive tape. The module 10 is attached near the edge of the drumhead, and it does not make any substantial difference what the longitudinal direction of the pickup module 10 is relative to the drumhead. The important factor in achieving the excellent response characteristics of the pickup 10 on a drumhead is the relatively flat pickup zone of the module 10 proximate the surface of the drumhead resulting from the very shallow depth of the sound guide slot 22.

The pickup module 10 of the invention has a number of other advantages over conventional microphones in addition to the surprisingly uniform response characteristics indicated by the response curve 70 of FIG. 10. Some of these advantages will next be described in applications of the pickup 10 to the harmonica, the accordion and the drumhead; however, it will be apparent from the following description of these additional advantages that the present invention may be advantageously used in connection with other musical instruments, and for various other applications independent of musical instruments.

One important advantage of the pickup 10 is that it is much less sensitive to feedback than the conventional open microphone. The area 38 of sensitivity of the microphone capsule 32 in pickup module 10 is very well sheltered by the sound guide slot 22 from speakers, whereas the conventional microphone is open to receive sounds from speakers, and hence is vulnerable to feedback. Another advantage of the present invention is that the pickup module 10 is selectively sensitive to the particular sound source with which the pickup is associated, while being substantially insensitive to other nearby sound sources and room ambiences. Thus, an accordion is conventionally miked by simply playing the accordion in front of a stationary microphone. Since the sound output level of the accordion is relatively low the amplification must be correspondingly relatively high, the sounds of other nearby instruments will be picked up and will interfere with miking of the accordion. The present invention when applied to an accordion as described above will be sensitive only to the output of the accordion.

Similarly, a snare or bass drum will be played in front of a stationary microphone, and much of the room ambience will be picked up in addition to the sounds of the drum. Feedback and lack of presence are also frequent problems in the conventional miking of drums. The close proximity of the pickup module 10 of the invention to the drumhead, and the selective directionality of the module 10, causes the present invention to completely overcome such problems in the miking of drums.

The conventional procedure for playing a harmonica into a microphone is for the player to hold the head of a conventional microphone inside of his cupped hands. The microphone is then physically in the player's way, making it hard to play. With the conventional microphone held this way, it would sometimes hit the harmonica, producing a clinking noise. Such microphone-holding problems are completely avoided with the present invention.

Another problem caused by holding the conventional microphone inside of the player's hands is that there is a resulting strong hand-shrouding or barrel sound effect involving a loud buildup of sound volume that is picked up by the open microphone. Such hand-shrouding effect is minimized by the present invention, while at the same time the invention is fully responsive to the desired normal hand-modulating effects.

A more general but analogous problem in the microphone art is a cavity effect in microphone bodies. This results from a conventional microphone construction wherein a miniature pressure type microphone capsule like the capsule 32 employed in the present invention is disposed within a much larger and generally hollow microphone body. The present invention is not vulnerable to any such cavity effect.

Another problem in miking a harmonica with a hand-held conventional microphone is that the microphone is exposed to wind noise from the harmonica. However, with the pickup module 10 of the invention mounted along the rear edge 64 of the reed bank 60 of the harmonica as shown in FIGS. 7, 8 and 9, the tiny openings at the ends of the sound guide slot 22 are sheltered from such wind noise, and no detectable wind noise is picked up.

The configuration and manner of playing the accordion introduces particularly difficult problems where the accordion is played in the conventional manner in front of a stationary microphone. The sound comes primarily out of the ends of the accordion case, and these are generally facing away from the microphone when the player is facing toward the microphone. Adding to that problem is the fact that the player is repeatedly pulling the bass end of the accordion away from the microphone in actuating the bellows. These problems are also completely avoided by employing pickup modules 10 of the invention mounted on reed banks in each of the treble and bass sections of the accordion.

Prototype testing of the present invention indicates that the very small cross-sectional size of the sound guide slot 22 is an important factor in achieving the surprising improvements described above of the invention over conventionally employed microphones.

While the instant invention has been shown and described herein in what is conceived to be the most practical and preferred embodiment, it is recognized that departures may be made therefrom within the scope of the invention, which is therefore not to be limited to the details disclosed herein, but is to accorded the full scope of the appended claims.

I claim:

1. A microphone pickup module having a generally elongated pattern of response, which comprises:

a body having an elongated channel extending therethrough between generally oppositely facing open ends; and a microphone mounted in said body and having a sound-sensitive surface area in communication with said channel intermediate said ends of said channel;

said elongated channel being generally flat, whereby said elongated pattern of response is also generally flat;

said sound-sensitive surface area being substantially centered along the length of said channel; and said channel being substantially straight.

2. A microphone pickup module as defined in claim 1, wherein said channel has a substantially uniform cross-section along its length.

3. A microphone pickup module as defined in claim 1, wherein said microphone is a miniature pressure-type microphone, and said sound-sensitive surface area is arranged substantially as a continuation of a generally flat surface in said channel.

4. A microphone pickup module having a generally elongated pattern of response, which comprises:

a body having an elongated channel extending therethrough between generally oppositely facing open ends; and a microphone mounted in said body and having a sound-sensitive surface area in communication with said channel intermediate said ends of said channel;

said elongated channel being generally flat, whereby said elongated pattern of response is also generally flat;

said channel having a cross-section that is generally rectangular and substantially uniform along its length; and the width of said generally rectangular cross-section being substantially five times the depth.

5. A microphone pickup module having a generally elongated pattern of response, which comprises:

a body having an elongated channel extending therethrough between generally oppositely facing open ends; and a microphone mounted in said body and having a sound-sensitive surface area in communication with said channel intermediate said ends of said channel;

said elongated channel being generally flat, whereby said elongated pattern of response is also generally flat;

said channel having a cross-section that is generally rectangular and substantially uniform along its length; and the length of said channel being substantially ten times the width.

6. A microphone pickup module having a generally elongated pattern of response, which comprises:

a body having an elongated channel extending therethrough between generally oppositely facing open ends; and a microphone mounted in said body and having a sound-sensitive surface area in communication with said channel intermediate said ends of said channel;

said elongated channel being generally flat, whereby said elongated pattern of response is also generally flat;

said sound-sensitive surface area being substantially centered along the length of said channel;

said channel being substantially straight; and said module being mounted on the rear edge of a harmonica reed bank with said channel generally parallel and central to said edge.

7. A microphone pickup module, having a generally elongated pattern of response, which comprises:

a body having an elongated channel extending therethrough between generally oppositely facing open ends; and a microphone mounted in said body and having a sound-sensitive surface area in communication with said channel intermediate said ends of said channel;

said elongated channel being generally flat, whereby said elongated pattern of response is also generally flat;

said sound-sensitive surface area being substantially centered along the length of said channel;

said channel being substantially straight; and said module being mounted on the rear edge of an accordion reed bank with said channel generally parallel and central to said rear edge.

* * * * *